US009677015B2

(12) United States Patent
Gupta et al.

(10) Patent No.: US 9,677,015 B2
(45) Date of Patent: Jun. 13, 2017

(54) STAGED SOLVENT ASSISTED HYDROPROCESSING AND RESID HYDROCONVERSION

(71) Applicants: Himanshu Gupta, Lorton, VA (US); Stephen Harold Brown, Annandale, NJ (US); Federico Barrai, New York, NY (US); Kirtan Kunjbihari Trivedi, Centreville, VA (US)

(72) Inventors: Himanshu Gupta, Lorton, VA (US); Stephen Harold Brown, Annandale, NJ (US); Federico Barrai, New York, NY (US); Kirtan Kunjbihari Trivedi, Centreville, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 248 days.

(21) Appl. No.: 14/308,932

(22) Filed: Jun. 19, 2014

(65) Prior Publication Data

US 2015/0027924 A1 Jan. 29, 2015

Related U.S. Application Data

(60) Provisional application No. 61/837,367, filed on Jun. 20, 2013, provisional application No. 61/837,363, filed on Jun. 20, 2013.

(51) Int. Cl.

| | |
|---|---|
| ***C10G 49/12*** | (2006.01) |
| ***C10G 65/02*** | (2006.01) |
| ***C10G 45/16*** | (2006.01) |
| ***C10G 47/26*** | (2006.01) |
| ***C10G 65/10*** | (2006.01) |
| ***C10G 65/12*** | (2006.01) |

(52) U.S. Cl.

CPC ..... *C10G 65/02* (2013.01); *C10G 45/16* (2013.01); *C10G 47/26* (2013.01); *C10G 49/12* (2013.01); *C10G 65/10* (2013.01); *C10G 65/12* (2013.01); *C10G 2300/301* (2013.01); *C10G 2300/4081* (2013.01); *C10G 2300/44* (2013.01)

(58) Field of Classification Search

CPC ..... C10G 49/12; C10G 65/02

See application file for complete search history.

(56) References Cited

U.S. PATENT DOCUMENTS

| | | | | |
|---|---|---|---|---|
| 5,755,955 | A | 5/1998 | Benham et al. | |
| 6,190,542 | B1 * | 2/2001 | Comolli | B01J 23/745 208/413 |
| 2007/0138058 | A1 | 6/2007 | Farshid et al. | |
| 2009/0057195 | A1 | 3/2009 | Powers et al. | |
| 2010/0122939 | A1 | 5/2010 | Bauer et al. | |
| 2011/0210045 | A1 | 9/2011 | Kou et al. | |
| 2013/0075303 | A1 | 3/2013 | Heraud et al. | |
| 2013/0112593 | A1 | 5/2013 | Montanari et al. | |
| 2013/0126392 | A1 | 5/2013 | Koseoglu | |

OTHER PUBLICATIONS

PCT Application No. PCT/US2014/043104, Communication from the International Searching Authority, Form PCT/ISA/210, dated Sep. 24, 2014, 10 pages.

* cited by examiner

*Primary Examiner* — Randy Boyer

(74) *Attorney, Agent, or Firm* — David M. Weisberg; Jamie L. Sullivan; Kristina Leavitt

(57) ABSTRACT

Systems and methods are provided for processing a heavy oil feed, such as an atmospheric or vacuum resid, using a combination of solvent assisted hydroprocessing and slurry hydroconversion of a heavy oil feed. The systems and methods allow for conversion and desulfurization/denitrogenation of a feed to form fuels and gas oil (or lubricant base oil) boiling range fractions while reducing the portion of the feed that is exposed to the high severity conditions present in slurry hydroconversion.

15 Claims, 6 Drawing Sheets

STAGED SOLVENT ASSISTED HYDROPROCESSING AND RESID HYDROCONVERSION

CROSS-REFERENCE TO RELATED APPLICATIONS

This application claims the benefit of priority from U.S. Provisional Application 61/837,367, filed on Jun. 20, 2013, titled "Staged Solvent Assisted Hydroprocessing and Resid Hydroconversion", the entirety of which is incorporated herein by reference. This application also claims the benefit of priority from U.S. Provisional Application 61/837,363, filed on Jun. 20, 2013, titled "Refinery Integration of Slurry Hydroconversion", the entirety of which is incorporated herein by reference.

FIELD OF THE INVENTION

This invention provides methods for processing of resids and other heavy oil feeds or refinery streams.

BACKGROUND OF THE INVENTION

Slurry hydroprocessing provides a method for conversion of high boiling, low value petroleum fractions into higher value liquid products. Slurry hydroconversion technology can process difficult feeds, such as feeds with high Conradson carbon residue (CCR), while still maintaining high liquid yields. In addition to resid feeds, slurry hydroconversion units have been used to process other challenging streams present in refinery/petrochemical complexes such as deasphalted rock, steam cracked tar, and visbreaker tar. Unfortunately, slurry hydroprocessing is also an expensive refinery process from both a capital investment standpoint and a hydrogen consumption standpoint.

Various slurry hydroprocessing configurations have previously been described. For example, U.S. Pat. No. 5,755,955 and U.S. Patent Application Publication 2010/0122939 provide examples of configurations for performing slurry hydroprocessing. U.S. Patent Application Publication 2011/0210045 also describes examples of configurations for slurry hydroconversion, including examples of configurations where the heavy oil feed is diluted with a stream having a lower boiling point range, such as a vacuum gas oil stream and/or catalytic cracking slurry oil stream, and examples of configurations where a bottoms portion of the product from slurry hydroconversion is recycled to the slurry hydroconversion reactor.

U.S. Patent Application Publication 2013/0075303 describes a reaction system for combining slurry hydroconversion with a coking process. An unconverted portion of the feed after slurry hydroconversion is passed into a coker for further processing. The resulting coke is described as being high in metals.

U.S. Patent Application Publication 2013/0112593 describes a reaction system for performing slurry hydroconversion on a deasphalted heavy oil feed. The asphalt from a deasphalting process and a portion of the unconverted material from the slurry hydroconversion can be gasified to form hydrogen and carbon oxides.

SUMMARY OF THE INVENTION

In an aspect, a method for processing a heavy oil feedstock is provided. The method includes providing a heavy oil feedstock having a 10% distillation point of at least about 650° F. (343° C.); exposing the heavy oil feedstock to a catalyst in the presence of hydrogen and a solvent under first effective hydroprocessing conditions to form an effluent comprising at least a plurality of liquid products and a hydroprocessing bottoms product, the effective hydroprocessing conditions including a temperature of at least about 360° C. and a liquid hourly space velocity of the fraction of the combined feedstock boiling above 1050° F. (566°) of at least about 0.10 $hr^{-1}$; exposing the hydroprocessing bottoms product to a catalyst in the presence of hydrogen under second effective slurry hydroconversion conditions to form a slurry hydroconversion effluent comprising at least a second plurality of liquid products and a bottoms product; and fractionating the first plurality of liquid products and the second plurality of liquid products.

In another aspect, a method for processing a heavy oil feedstock is provided. The method includes providing a heavy oil feedstock having a 10% distillation point of at least about 650° F. (343° C.); exposing the heavy oil feedstock to a catalyst in the presence of hydrogen under first effective slurry hydroconversion conditions to form a slurry hydroconversion effluent comprising at least a plurality of liquid products and a bottoms product, wherein the hydrogen is provided by reforming of a reformable fuel, and wherein the hydrogen and the heavy oil feedstock are heated in a common heating zone.

DETAILED DESCRIPTION OF THE EMBODIMENTS

Overview

Figure 1:
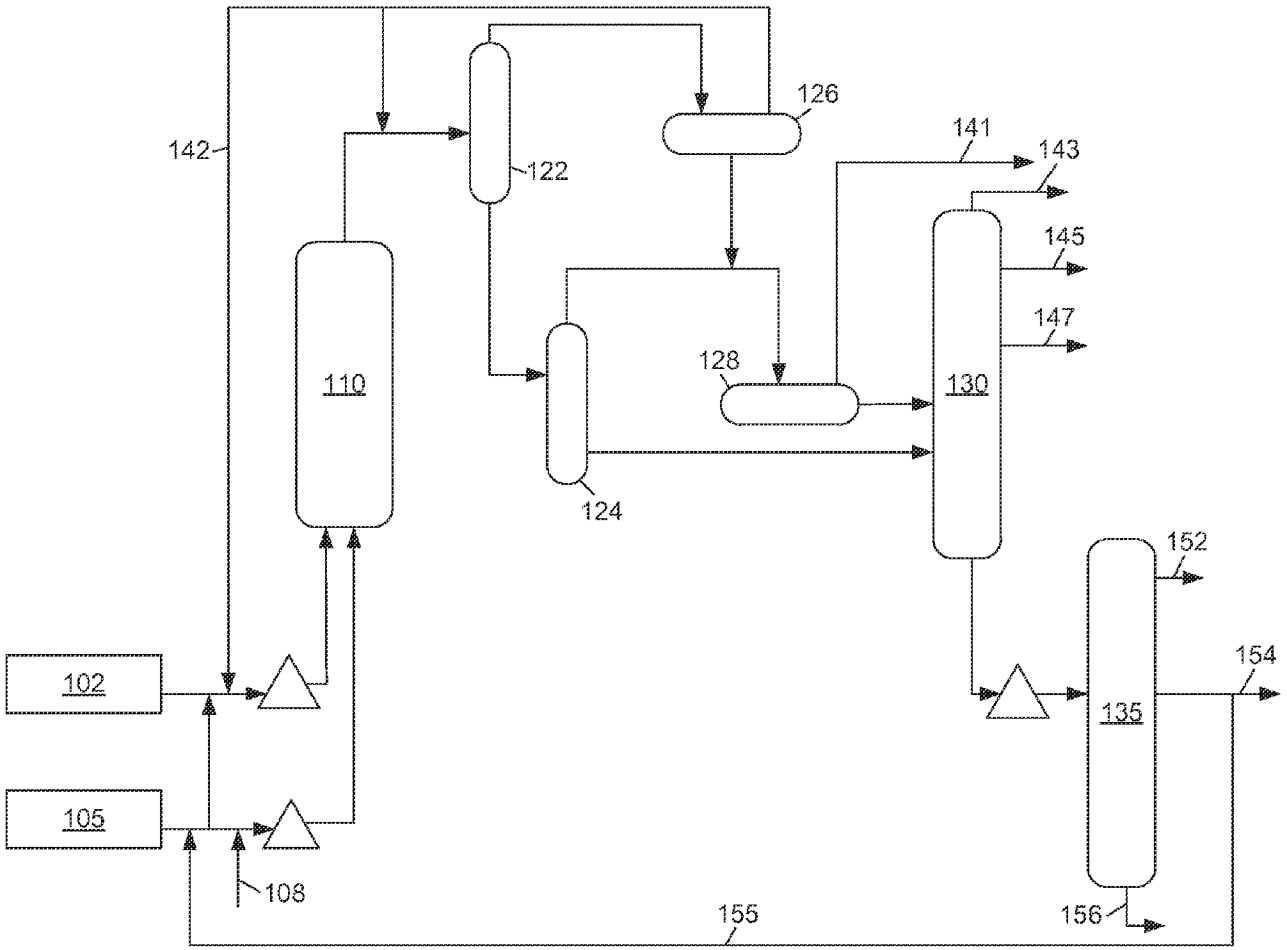
FIG. 1 shows an example of a slurry hydroconversion reaction system.

In various aspects, systems and methods are provided for processing a heavy oil feed, such as an atmospheric or vacuum resid, using a combination of solvent assisted hydroprocessing and slurry hydroconversion of a heavy oil feed. The systems and methods allow for conversion and desulfurization/denitrogenation of a feed to form fuels and gas oil (or lubricant base oil) boiling range fractions while reducing the portion of the feed that is exposed to the high severity conditions present in slurry hydroconversion.

Additionally or alternately, in some aspects, systems and methods are provided for slurry hydroconversion of a heavy oil feed, such as an atmospheric or vacuum resid. The systems and methods allow for reduced energy consumption during slurry hydroconversion by integrating slurry hydroconversion reactor(s) with other refinery systems. Additionally, an alternative configuration is provided for operating a slurry hydroconversion reaction system. The output effluent from slurry hydrocracking can be quenched using a portion of one or more product fractions, such as a naphtha fraction, a diesel (distillate fuel) fraction, a light vacuum gas oil fraction, or a heavy vacuum gas oil fraction.

Feedstocks

In various aspects, a hydroprocessed product is produced from a heavy oil feed component. Examples of heavy oils include, but are not limited to, heavy crude oils, distillation residues, heavy oils coming from catalytic treatment (such as heavy cycle bottom slurry oils from fluid catalytic cracking), thermal tars (such as oils from visbreaking, steam cracking, or similar thermal or non-catalytic processes), oils (such as bitumen) from oil sands and heavy oils derived from coal.

Heavy oil feedstocks can be liquid or semi-solid. Examples of heavy oils that can be hydroprocessed, treated or upgraded according to this invention include bitumens and residuum from refinery distillation processes, including atmospheric and vacuum distillation processes. Such heavy oils can have an initial boiling point of 650° F. (343° C.) or greater. Preferably, the heavy oils will have a 10% distillation point of at least 650° F. (343° C.), alternatively at least 660° F. (349° C.) or at least 750° F. (399° C.). In some aspects the 10% distillation point can be still greater, such as at least 900° F. (482° C.), or at least 950° F. (510° C.), or at least 975° F. (524° C.), or at least 1020° F. (549° C.) or at least 1050° F. (566° C.). In this discussion, boiling points can be determined by a convenient method, such as ASTM D86, ASTM D2887, or another suitable standard method.

In addition to initial boiling points and/or 10% distillation points, other distillation points may also be useful in characterizing a feedstock. For example, a feedstock can be characterized based on the portion of the feedstock that boils above 1050° F. (566° C.). In some aspects, a feedstock can have a 70% distillation point of 1050° F. or greater, or a 60% distillation point of 1050° F. or greater, or a 50% distillation point of 1050° F. or greater, or a 40% distillation point of 1050° F. or greater.

Density, or weight per volume, of the heavy hydrocarbon can be determined according to ASTM D287-92 (2006) Standard Test Method for API Gravity of Crude Petroleum and Petroleum Products (Hydrometer Method), and is provided in terms of API gravity. In general, the higher the API gravity, the less dense the oil. API gravity 20° or less in one aspect, 15° or less in another aspect, and 10° or less in another aspect.

Heavy oil feedstocks (also referred to as heavy oils) can be high in metals. For example, the heavy oil can be high in total nickel, vanadium and iron contents. In one embodiment, the heavy oil will contain at least 0.00005 grams of Ni/V/Fe (50 ppm) or at least 0.0002 grams of Ni/V/Fe (200 ppm) per gram of heavy oil, on a total elemental basis of nickel, vanadium and iron. In other aspects, the heavy oil can contain at least about 500 wppm of nickel, vanadium, and iron, such as at least about 1000 wppm.

Contaminants such as nitrogen and sulfur are typically found in heavy oils, often in organically-bound form. Nitrogen content can range from about 50 wppm to about 10,000 wppm elemental nitrogen or more, based on total weight of the heavy hydrocarbon component. The nitrogen containing compounds can be present as basic or non-basic nitrogen species. Examples of basic nitrogen species include quinolines and substituted quinolines. Examples of non-basic nitrogen species include carbazoles and substituted carbazoles.

The invention is particularly suited to treating heavy oil feedstocks containing at least 500 wppm elemental sulfur, based on total weight of the heavy oil. Generally, the sulfur content of such heavy oils can range from about 500 wppm to about 100,000 wppm elemental sulfur, or from about 1000 wppm to about 50,000 wppm, or from about 1000 wppm to about 30,000 wppm, based on total weight of the heavy component. Sulfur will usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, and di- and polysulfides.

Heavy oils can be high in n-pentane asphaltenes. In some aspects, the heavy oil can contain at least about 5 wt % of n-pentane asphaltenes, such as at least about 10 wt % or at least 15 wt % n-pentane asphaltenes.

Still another method for characterizing a heavy oil feedstock is based on the Conradson carbon residue of the feedstock. The Conradson carbon residue of the feedstock can be at least about 5 wt %, such as at least about 10 wt % or at least about 20 wt %. Additionally or alternately, the Conradson carbon residue of the feedstock can be about 50 wt % or less, such as about 40 wt % or less or about 30 wt % or less.

Slurry Hydroprocessing

FIG. 1 shows an example of a reaction system suitable for performing slurry hydroprocessing. The configuration in FIG. 1 is provided as an aid in understanding the general features of a slurry hydroprocessing process. It should be understood that, unless otherwise specified, the conditions described in association with FIG. 1 can generally be applied to any convenient slurry hydroprocessing configuration.

In FIG. 1, a heavy oil feedstock 105 is mixed with a catalyst 108 prior to entering one or more slurry hydroprocessing reactors 110. The mixture of feedstock 105 and catalyst 108 can be heated prior to entering reactor 110 in order to achieve a desired temperature for the slurry hydroprocessing reaction. A hydrogen stream 102 is also fed into reactor 110. In the configuration shown in FIG. 1, both the feedstock 105 and hydrogen stream 102 are shown as being heated prior to entering reactor 110. Optionally, a portion of feedstock 105 can be mixed with hydrogen stream 102 prior to hydrogen stream 102 entering reactor 110. Optionally, feedstock 105 can also include a portion of recycled vacuum gas oil 155. Optionally, hydrogen stream 102 can also include a portion of recycled hydrogen 142.

The effluent from slurry hydroprocessing reactor(s) 110 is passed into one or more separation stages. For example, an initial separation stage can be a high pressure, high temperature (HPHT) separator 122. A higher boiling portion from the HPHT separator 122 can be passed to a low pressure, high temperature (LPHT) separator 124 while a lower boiling (gas) portion from the HPHT separator 122 can be passed to a high temperature, low pressure (HILT) separator 126. The higher boiling portion from the LPHT separator 124 can be passed into a fractionator 130. The lower boiling portion from LPHT separator 124 can be combined with the higher boiling portion from WILT separator 126 and passed into a low pressure, low temperature (LPLT) separator 128. The lower boiling portion from HPLT separator 126 can be used as a recycled hydrogen stream 142, optionally after removal of gas phase contaminants from the stream such as $H_2S$ or $NH_3$. The lower boiling portion from LPLT separator 128 can be used as a flash gas or fuel gas 141. The higher boiling portion from LPLT separator 128 is also passed into fractionator 130.

In some configurations, HPHT separator 122 can operate at a temperature similar to the outlet temperature of the slurry hydroconversion reactor 110. This reduces the amount of energy required to operate the HPHT separator 122. However, this also means that both the lower boiling portion and the higher boiling portion from the HPHT separator 122 undergo the full range of distillation and further processing steps prior to any recycling of unconverted feed to reactor 110.

In an alternative configuration, the higher boiling portion from HPHT separator 122 is used as a recycle stream 118 that is added back into feed 105 for processing in reactor 110. In this type of alternative configuration, the effluent from reactor 110 can be heated to reduce the amount of converted material that is recycled via recycle stream 118. This allows the conditions in HPHT separator 122 to be separated from the reaction conditions in reactor 110.

In FIG. 1, fractionator 130 is shown as an atmospheric fractionator. The fractionator 130 can be used to form a plurality of product streams, such as a light ends or $C4^-$ stream 143, one or more naphtha streams 145, one or more diesel and/or distillate (including kerosene fuel streams 147, and a bottoms fraction. The bottoms fraction can then be passed into vacuum fractionator 135 to form, for example, a light vacuum gas oil 152, a heavy vacuum gas oil 154, and a bottoms or pitch fraction 156. Optionally, other types and/or more types of vacuum gas oil fractions can be generated from vacuum fractionator 135. The heavy vacuum gas oil fraction 154 can be at least partially used to form a recycle stream 155 for combination with heavy oil feed 105.

In a reaction system, slurry hydroprocessing can be performed by processing a feed in one or more slurry hydroprocessing reactors. The reaction conditions in a slurry hydroprocessing reactor can vary based on the nature of the catalyst, the nature of the feed, the desired products, and/or the desired amount of conversion.

With regard to catalyst, suitable catalyst concentrations can range from about 50 wppm to about 20,000 wppm (or about 2 wt %), depending on the nature of the catalyst. Catalyst can be incorporated into a hydrocarbon feedstock directly, or the catalyst can be incorporated into a side or slip stream of feed and then combined with the main flow of feedstock. Still another option is to form catalyst in-situ by introducing a catalyst precursor into a feed (or a side/slip stream of feed) and forming catalyst by a subsequent reaction.

Catalytically active metals for use in hydroprocessing can include those from Group IVB, Group VB, Group VIB, Group VIIB, or Group VIII of the Periodic Table. Examples of suitable metals include iron, nickel, molybdenum, vanadium, tungsten, cobalt, ruthenium, and mixtures thereof. The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

A catalyst in the form of a solid particulate is generally a compound of a catalytically active metal, or a metal in elemental form, either alone or supported on a refractory material such as an inorganic metal oxide (e.g., alumina, silica, titania, zirconia, and mixtures thereof). Other suitable refractory materials can include carbon, coal, and clays. Zeolites and non-zeolitic molecular sieves are also useful as solid supports. One advantage of using a support is its ability to act as a "coke getter" or adsorbent of asphaltene precursors that might otherwise lead to fouling of process equipment.

In some aspects, it can be desirable to form catalyst for slurry hydroprocessing in situ, such as forming catalyst from a metal sulfate (e.g., iron sulfate monohydrate) catalyst precursor or another type of catalyst precursor that decomposes or reacts in the hydroprocessing reaction zone environment, or in a pretreatment step, to form a desired, well-dispersed and catalytically active solid particulate e.g., as iron sulfide). Precursors also include oil-soluble organometallic compounds containing the catalytically active metal of interest that thermally decompose to form the solid particulate (e.g., iron sulfide) having catalytic activity. Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina).

The reaction conditions within a slurry hydroconversion reactor can include a temperature of about 400° C. to about 480° C., such as at least about 425° C., or about 450° C. or less. Some types of slurry hydroconversion reactors are operated under high hydrogen partial pressure conditions, such as having a hydrogen partial pressure of about 1200 psig (8.3 MPag) to about 3400 psig (214 MPag), for example at least about 1500 psig (10.3 MPag), or at least about 2000 psig (118 MPag). Examples of hydrogen partial pressures can be about 1200 psig (8.3 MPag) to about 3000 psig (20.7 MPag), or about 1200 psig (8.3 MPag) to about 2500 psig (17.2 MPag), or about 1500 psig (10.3 MPag) to about 3400 psig (23.4 MPag), or about 1500 psig (10.3 MPag) to about 3000 psig (20.7 MPag), or about 1500 psig (8.3 MPag) to about 2500 psig (17.2 MPag), or about 2000 psig (13.8 MPag) to about 3400 psig (23.4 Wag), or about 2000 psig (13.8 MPag) to about 3000 psig (20.7 MPag). Since the catalyst is in slurry form within the feedstock, the space velocity for a slurry hydroconversion reactor can be characterized based on the volume of feed processed relative to the volume of the reactor used for processing the feed. Suitable space velocities for stuffy hydroconversion can range, for example, from about 0.05 $v/v/hr^{-1}$ to about 5 $v/v/hr^{-1}$, such as about 0.1 $v/v/hr^{-1}$ to about 2 $v/v/hr^{-1}$.

The reaction conditions for slurry hydroconversion can be selected so that the net conversion of feed across all slurry hydroconversion reactors (if there is more than one arranged in series) is at least about 80%, such as at least about 90%, or at least about 95%. For slurry hydroconversion, conversion is defined as conversion of compounds with boiling points greater than a conversion temperature, such as 975° F. (524° C.), to compounds with boiling points below the conversion temperature. Alternatively, the conversion temperature for defining the amount of conversion can be 1050° F. (566° C.). The portion of a heavy feed that is unconverted after slurry hydroconversion can be referred to as pitch or a bottoms fraction from the slurry hydroconversion.

Definitions

In order to clarify the description solvent assisted hydroprocessing, the following definitions are provided. The following definitions should be applied throughout the description herein unless otherwise specified.

In some embodiments of the invention, reference is made to conversion of a feedstock relative to a conversion temperature T. Conversion relative to a temperature T is defined based on the portion of the feedstock that boils at a temperature greater than the conversion temperature T. The amount of conversion during a process (or optionally across multiple processes) is defined as the weight percentage of the feedstock that is converted from boiling at a temperature above the conversion temperature T to boiling at a temperature below the conversion temperature T. For example, consider a feedstock that includes 40 wt % of components that boils at 1050° F. (566° C.) or greater. By definition, the remaining 60 wt % of the feedstock boils at less than 1050° F. (566° C.). For such a feedstock, the amount of conversion relative to a conversion temperature of 1050° F. (566° C.) would be based only on the 40 wt % that initially boils at 1050° F. (566° C.) or greater. If such a feedstock is exposed to a process with 30% conversion relative to a 1050° F. (566° C.) conversion temperature, the resulting product would include 72 wt % of components boiling below 1050° F. (566° C.) and 28 wt % of components boiling above 1050° F. (566° C.).

In various aspects of the invention, reference may be made to one or more types of fractions generated during distillation of a petroleum feedstock. Such fractions may include naphtha fractions, kerosene fractions, diesel fractions, and vacuum gas oil fractions. Each of these types of fractions can be defined based on a boiling range, such as a boiling range that includes at least 90 wt % of the fraction, and preferably at least 95 wt % of the fraction. For example, for many types of naphtha fractions, at least 90 wt % of the fraction, and preferably at least 95 wt %, can have a boiling point in the range of 85° F. (29° C.) to 350° F. (177° C.). For some heavier naphtha fractions, at least 90 wt % of the fraction, and preferably at least 95 wt a, can have a boiling point in the range of 85° F. (29° C.) to 400° F. (204° C.). For a kerosene fraction, at least 90 wt % of the fraction, and preferably at least 95 wt %, can have a boiling point in the range of 300° F. (149° C.) to 600° F. (288° C.). Alternatively, for a kerosene fraction targeted for some uses, such as jet fuel production, at least 90 wt % of the fraction, and preferably at least 95 wt %, can have a boiling point in the range of 300° F. (149° C.) to 550° F. (288° C.). For a diesel fraction, at least 90 wt % of the fraction, and preferably at least 95 wt %, can have a boiling point in the range of 400° F. (204° C.) to 750° F. (399° C.). For a vacuum gas oil fraction, at least 90 wt % of the fraction, and preferably at least 95 wt %, can have a boiling point in the range of 650° F. (343° C.) to 1100° F. (593° C.). Optionally, for some vacuum gas oil fractions, a narrower boiling range may be desirable. For such vacuum gas oil fractions, at least 90 wt % of the fraction, and preferably at least 95 wt %, can have a boiling point in the range of 650° F. (343° C.) to 1000° F. (538° C.).

Solvent Assisted Hydroprocessing—Solvent

In various aspects of the invention, the hydroprocessing of a heavy oil feed component is facilitated by adding a solvent component. Two types of solvent components are contemplated in various aspects. One type of solvent component is a solvent component that contains at least one single-ring aromatic ring compound, and more preferably more than one single-ring aromatic ring compound. The solvent is also a low boiling solvent relative to the heavy hydrocarbon oil. By the term "single-ring aromatic compound" as used herein, it is defined as a hydrocarbon compound containing only one cyclic ring wherein the cyclic ring is aromatic in nature.

For a solvent component containing at least one single-ring aromatic compound, the solvent preferably has an ASTM D86 90% distillation point of less than 300° C. (572° F.). Alternatively, the solvent has an ASTM D86 90% distillation point of less than 250° C. (482° F.) or less than 200° C. (392° F.) Additionally or alternately, the solvent can have an ASTM D86 10% distillation point of at least 120° C. (248° F.), such as at least 140° C. (284° F.) or at least 150° C. (302° F.).

The single-ring aromatic compound or compounds in particular have relatively low boiling points compared to the heavy hydrocarbon oil. Preferably, none of the single-ring aromatic compounds of the solvent has a boiling point of greater than 550° F. (288° C.), or greater than 500° F. (260° C.), or greater than 450° F. (232° C.), or greater than 400° F. (204° C.).

The single-ring aromatic can include one or more hydrocarbon substituents, such as from 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl and $C_1$-$C_6$ alkenyl, wherein the hydrocarbon groups can be branched or linear and the hydrocarbon groups can be the same or different. A particular example of such a single-ring aromatic that includes one or more hydrocarbon substituents is trimethylbenzene (TMB).

The solvent preferably contains sufficient single-ring aromatic component(s) to effectively increase nm length during hydroprocessing. For example, the solvent can be comprised of about 20 wt % to about 80 wt % of the single ring aromatic component, such as at least 50 wt % of the single-ring aromatic component, or at least 60 wt %, or at least 70 wt %, based on total weight of the solvent component.

The density of the solvent component can also be determined according to ASTM D287-92 (2006) Standard Test Method for API Gravity of Crude Petroleum and Petroleum Products (Hydrometer Method) in terms of API gravity. API gravity of the solvent component is at most 35° in one aspect, at most 30° in another aspect, and at most 25° in another aspect.

In other aspects of the invention, the solvent component can correspond to a recycle stream of a portion of the liquid effluent or product generated from the hydroprocessing reaction and/or the slurry hydroconversion reaction. The recycle stream can be a portion of the total liquid effluent from hydroprocessing, or the recycle stream can include a portion of one or more distillation fractions of the liquid product from hydroprocessing and/or slurry hydroconversion. An example of a recycle stream corresponding to a portion of a distillation fraction is a recycle stream corresponding to a portion of the distillate boiling range product from hydroprocessing of the heavy feed.

Recycling a portion of the total liquid effluent from hydroprocessing for use as a solvent provides a variety of advantages. Because the recycled portion is a part of the total liquid effluent, a separation does not have to be performed to recover the solvent after hydroprocessing. Instead, the output effluent from hydroprocessing can simply be divided to form a product stream and a recycle stream. In some embodiments, fractionation of the total liquid product may not occur until after additional processing is performed, such as additional hydroprocessing to remove contaminants or improve cold flow properties. Recycling a portion of the total liquid effluent means that fully hydroprocessed products are not recycled to an early stage, which can increase the available processing volume for later hydroprocessing stages.

Optionally, other portions of the hydroprocessed product may be recycled in addition to the portion of the total liquid effluent. For example, after withdrawing the recycle stream portion of the total liquid effluent, the remaining portion of the total liquid effluent may be separated or fractionated to form various fractions, such as one or more naphtha fractions, one or more kerosene and/or distillate fractions, one or more atmospheric or vacuum gas oil fractions, and a bottoms or resid fraction. A portion of one or more of these product fractions can also be recycled for use as part of the combined hydroprocessing feed. For example, a portion of a kerosene product fraction or distillate product fraction can be recycled and combined with the heavy oil feed and the recycled portion of the total liquid effluent to form the hydroprocessing feed. These recycled product fractions, based on recycle of one or more fractions that have a narrower boiling range than the total liquid product, can correspond to at least about 2 wt % of the combined hydroprocessing feed, such as at least about 5 wt % or at least about 10 wt %. Such recycled product fractions can correspond to about 50 wt % or less of the combined hydroprocessing feed, and preferably about 25 wt % of the combined hydroprocessing feed or less, such as about 15 wt % or less or 10 wt % or less.

One potential concern with using a product fraction as a recycle stream is the possibility of further conversion of the recycled product fraction during hydroprocessing. For example, a product fraction where 90 wt % of the product fraction boils in a boiling range of 300° F. (149° C.) to 600° F. (316° C.) corresponds to a kerosene fraction. Further conversion of this product fraction when used as a recycle solvent would result in formation of additional components with boiling points less than 300° F. (149° C.). Such low boiling point components correspond to either naphtha or light ends, which are lower value fractions. Preferably, less than 10 wt % of a product fraction is converted to components with a boiling point below the boiling range of the product fraction when exposed to the hydroprocessing environment as a recycle solvent, and more preferably less than 5 wt % of a recycled product fraction undergoes conversion.

In an alternative aspect of the invention, the total liquid effluent from the hydroprocessing reaction can be fractionated, so that the only recycle inputs to the hydroprocessing feed are recycled portions from the product fractions. In this type of aspect, the amount of recycled product fractions can correspond to at least about 10 wt % of the hydroprocessing feed, such as at least about 20 wt %. The amount of recycled product fractions can correspond to about 50 wt % or less, such as about 30 wt % or less. Suitable product fractions for recycle include kerosene fractions, distillate (including diesel) fractions, gas oil fractions (including atmospheric and vacuum gas oils), and combinations thereof.

The solvent component should be combined with the heavy hydrocarbon oil component to effectively increase run length during hydroprocessing. For example, the solvent and heavy hydrocarbon component can be combined so as to produce a combined feedstock that is comprised of from 10 wt % to 90 wt % of the heavy hydrocarbon oil component and from 10 wt % to 90 wt % of the solvent component, based on total weight of the combined feed. Alternatively, the solvent and heavy hydrocarbon component are combined so as to produce a combined feedstock that is comprised of from 30 wt % to 80 wt % of the heavy hydrocarbon oil component and from 20 wt to 70 wt % of the solvent component, based on total weight of the combined feed. In some aspects, the solvent component is about 50 wt % or less of the combined feedstock, such as about 40 wt % or less or about 30 wt % or less. In other aspects where at least a portion of the solvent component corresponds to a recycled portion of the total liquid effluent, the solvent component can be greater than 50 wt % of the combined feedstock.

Another way of characterizing an amount of feedstock relative to an amount of solvent component, such as a recycle component, is as a ratio of feedstock to solvent component. For example, the ratio of feedstock to solvent component on a weight basis can be from about 0.3 to about 6.0, such as at least about 0.5 and/or less than about 5.0 or less than about 3.0.

The solvent can be combined with the heavy hydrocarbon oil within the hydroprocessing vessel or hydroprocessing zone. Alternatively, the solvent and heavy hydrocarbon oil can be supplied as separate streams and combined into one feed stream prior to entering the hydroprocessing vessel or hydroprocessing zone.

In still another option, instead of feeding a solvent component corresponding to a recycled portion of the total liquid effluent into a reactor from the reactor inlet, part of the solvent may be fed to the reactor via interbed quench zones. This would allow the solvent to help control reaction exothermicity (adiabatic temperature rise) and improve the liquid flow distribution in the reactor bed.

Solvent Assisted Hydroprocessing—Catalysts

The catalysts used for hydroconversion of a heavy oil feed can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. It is within the scope of the invention that more than one type of hydroprocessing catalyst can be used in one or multiple reaction vessels.

The at least one Group VIII non-noble metal, in oxide form, can typically be present in an amount ranging from about 2 wt % to about 30 wt %, preferably from about 4 wt % to about 15 wt %. The at least one Group VI metal, in oxide form, can typically be present in an amount ranging from about 2 wt % to about 60 wt %, preferably from about 6 wt % to about 40 wt % or from about 10 wt % to about 30 wt %. These weight percents are based on the total weight of the catalyst. It is noted that under hydroprocessing conditions, the metals may be present as metal sulfides and/or may be converted metal sulfides prior to performing hydroprocessing on an intended feed.

A vessel or hydroprocessing zone in which catalytic activity occurs can include one or more hydroprocessing catalysts. Such catalysts can be mixed or stacked, with the catalyst preferably being in a fixed bed in the vessel or hydroprocessing zone.

The support can be impregnated with the desired metals to form the hydroprocessing catalyst. In particular impregnation embodiments, the support is heat treated at temperatures in a range of from 400° C. to 1200° C. (752° F. to 2192° F.), or from 450° C. to 1000° C. (842° F. to 1832° F.), or from 600° C. to 900° C. (1112° F. to 1652° F.), prior to impregnation with the metals.

In an alternative embodiment, the hydroprocessing catalyst is comprised of shaped extrudates. The extrudate diameters range from $\frac{1}{32}$nd to $\frac{1}{8}^{th}$ inch, from $\frac{1}{20}^{th}$ to $\frac{1}{10}^{th}$ inch, or from $120^{th}$ to $\frac{1}{16}^{th}$ inch. The extrudates can be cylindrical or shaped. Non-limiting examples of extrudate shapes include trilobes and quadralobes.

The process of this invention can be effectively carried out using a hydroprocessing catalyst having any median pore diameter effective for hydroprocessing the heavy oil component. For example, the median pore diameter can be in the range of from 30 to 1000 Å (Angstroms), or 50 to 500 Å, or 60 to 300 Å. Pore diameter is preferably determined according to ASTM Method D4284-07 Mercury Porosimetry.

In a particular embodiment, the hydroprocessing catalyst has a median pore diameter in a range of from 50 to 200 Å. Alternatively, the hydroprocessing catalyst has a median pore diameter in a range of from 90 to 180 Å, or 100 to 140 Å, or 110 to 130 Å.

The process of this invention is also effective with hydroprocessing catalysts having a larger median pore diameter. For example, the process can be effective using a hydroprocessing catalyst having a median pore diameter in a range of from 180 to 500 Å, or 200 to 300 Å, or 230 to 250 Å.

It is preferred that the hydroprocessing catalyst have a pore size distribution that is not so great as to negatively impact catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 to 180 Å, or from 60 to 150 Å, with at least 60% of the pores having a pore diameter within 45 Å, 35 Å, or 25 Å of the median pore diameter.

In some alternative embodiments, the process of this invention can be effectively carried out using a hydroprocessing catalyst having a median pore diameter of at least 85 Å, such as at least 90 Å, and a median pore diameter of 120 Å or less, such as 105 Å or less. This can correspond, for example, to a catalyst with a median pore diameter from 85 Å to 120 Å, such as from 85 Å to 100 Å or from 85 Å to 98 Å. In certain alternative embodiments, the catalyst has a median pore diameter in a range of from 85 Å to 120 Å, with at least 60% of the pores having a pore diameter within 45 Å, 35 Å, or 25 Å of the median pore diameter.

Pore volume should be sufficiently large to further contribute to catalyst activity or selectivity. For example, the hydroprocessing catalyst can have a pore volume of at least 0.3 $cm^3/g$, at least 0.7 $cm^3/g$, or at least 0.9 $cm^3/g$. In certain embodiments, pore volume can range from 0.3-0.99 $cm^3/g$, 0.4-0.8 $cm^3/g$, or 0.5-0.7 $cm^3/g$.

In certain aspects, the catalyst exists in shaped forms, for example, pellets, cylinders, and/or extrudates. The catalyst typically has a flat plate crush strength in a range of from 50-500 N/cm, or 60-400 N/cm, or 100-350 N/cm, or 200-300 N/cm, or 220-280 N/cm.

In some aspects, a combination of catalysts can be used for hydroprocessing of a heavy oil feed. For example, a heavy oil feed can be contacted first by a demetallation catalyst, such as a catalyst including NiMo or CoMo on a support with a median pore diameter of 200 Å or greater. A demetallation catalyst represents a lower activity catalyst that is effective for removing at least a portion of the metals content of a feed. This allows a less expensive catalyst to be used to remove a portion of the metals, thus extending the lifetime of any subsequent higher activity catalysts. The demetallized effluent from the demetallation process can then be contacted with a catalyst having a different median pore diameter, such as a median pore diameter of 85 Å to 120 Å.

Solvent Assisted Hydroprocessing—Processing Conditions

Hydroprocessing (alternatively hydroconversion) generally refers to treating or upgrading the heavy hydrocarbon oil component that contacts the hydroprocessing catalyst. Hydroprocessing particularly refers to any process that is carried out in the presence of hydrogen, including, but not limited to, hydroconversion, hydrocracking (which includes selective hydrocracking), hydrogenation, hydrotreating, hydrodesulfurization, hydrodenitrogenation, hydrodemetallation, hydrodearomatization, hydroisomerization, and hydrodewaxing including selective hydrocracking. The hydroprocessing reaction is carried out in a vessel or a hydroprocessing zone in which heavy hydrocarbon and solvent contact the hydroprocessing catalyst in the presence of hydrogen.

Contacting conditions in the contacting or hydroprocessing zone can include, but are not limited to, temperature, pressure, hydrogen flow, hydrocarbon feed flow, or combinations thereof. Contacting conditions in some embodiments are controlled to yield a product with specific properties.

Hydroprocessing is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to herein, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrogen can be supplied at a rate of from 300 SCF/B (standard cubic feet of hydrogen per barrel of feed) (53 S $m^3/m^3$) to 10000 SCF/B (1780 S $m^3/m^3$). Preferably, the hydrogen is provided in a range of from 1000 SCF/B (178 S $m^3/m^3$) to 5000 SCF/B (891 S $m^3/m^3$).

Hydrogen can be supplied co-currently with the heavy hydrocarbon oil and/or solvent or separately via a separate gas conduit to the hydroprocessing zone. The contact of the heavy hydrocarbon oil and solvent with the hydroprocessing catalyst and the hydrogen produces a total product that includes a hydroprocessed oil product, and, in some embodiments, gas.

The temperature in the contacting zone can be at least about 680° F. (360° C.), such as at least about 700° F. (371° C.), and preferably at least about 716° F. (380° C.), such as at least about 750° F. (399° C.) or at least about 788° F. (420° C.). Additionally or alternately, the temperature in the contacting zone can be about 950° F. (510° C.) or less, such as about 900° F. (482° C.) or less, and preferably about 869° F. (46.5° C.) or less or about 842° F. (450° C.) or less.

Total pressure in the contacting zone can range from 200 psig (1379 kPa-g) to 3000 psig (20684 kPa-g), such as from 400 psig (2758 kPa-g) to 2000 psig (13790 kPa-g), or from 650 psig (4482 kPa-g) to 1500 psig (10342 kPa-g), or from 650 psig (4482 kPa-g) to 1200 psig (8273 kPa-g). Preferably, a heavy oil can be hydroprocessed under low hydrogen partial pressure conditions. In such aspects, the hydrogen partial pressure during hydroprocessing can be from about 200 psig (1379 kPa-g) to about 1000 psig (6895 kPa-g), such as from 500 psig (3447 kPa-g) to about 800 psig (5516 kPa-g). Additionally or alternately, the hydrogen partial pressure can be at least about 200 psig (1379 kPa-g), or at least about 400 psig (2758 kPa-g), or at least about 600 psig (4137 kPa-g). Additionally or alternately, the hydrogen partial pressure can be about 1000 psig (6895 kPa-g) or less, such as about 900 psig (6205 kPa-g) or less, or about 850 psig (5861 kPa-g) or less, or about 800 psig (5516 kPa-g) or less, or about 750 psig (5171 kPa-g) or less. In such aspects with low hydrogen partial pressure, the total pressure in the reactor can be about 1200 psig (8274 kPa-g) or less, and preferably 1000 psig (6895 kPa-g) or less, such as about 900 psig (6205 kPa-g) or less or about 800 psig (5516 kPa-g) or less.

Liquid hourly space velocity (LHSV) of the combined heavy hydrocarbon oil and recycle components will generally range from 0.1 to 30 $h^{-1}$, or 0.4 $h^{-1}$ to 20 $h^{-1}$, or 0.5 to 10 $h^{-1}$. In some aspects, LHSV is at least 15 $h^{-1}$, or at least 10 $h^{-1}$ or at least 5 $h^{-}$. Alternatively, in some aspects LHSV is about 2.0 $h^{-1}$ or less, or about 1.5 $h^{-1}$ or less, or about 1.0 $h^{-1}$ or less.

Based on the reaction conditions described above, in various aspects of the invention, a portion of the reactions taking place in the hydroprocessing reaction environment can correspond to thermal cracking reactions. In addition to the reactions expected during hydroprocessing of a feed in the presence of hydrogen and a hydroprocessing catalyst, thermal cracking reactions can also occur at temperatures of 360° C. and greater. In the hydroprocessing reaction environment, the presence of hydrogen and catalyst can reduce the likelihood of coke formation based on radicals formed during thermal cracking.

In an embodiment of the invention, contacting the input feed to the hydroconversion reactor with the hydroprocessing catalyst in the presence of hydrogen to produce a hydroprocessed product is carried out in a single contacting zone. In another aspect, contacting is carried out in two or more contacting zones.

In various embodiments of the invention, the combination of processing conditions can be selected to achieve a desired level of conversion of a feedstock. For various types of heavy oil feedstocks, conversion relative to a conversion temperature of 1050° F. (566° C.) is a convenient way to characterize the amount of feedstock conversion. For example, the process conditions can be selected to achieve at least about 25% conversion of the 1050° F.+ portion of a feedstock. In other words, the conditions are selected so that at least about 25 wt % of the portion of the feed that boils above 1050° F. (566° C.) is converted to a portion that boils below 1050° F. (66° C. In some aspects, the amount of conversion relative to 1050° F. (566° C.) can be at least about 40%, such as at least about 50% or at least about 60%. Additionally or alternately the conversion percentage can be about 80% or less, such as about 5% or less or about 70% or less. An example of a suitable amount of conversion can be a conversion percentage from about 40% to about 80%, such as about 50% to about 70%.

In other embodiments of the invention, a greater amount of conversion may be desirable. For example, in order to segregate molecules with low hydrogen to carbon ratios using hydroprocessing, a conversion percentage of at least about 80% can be desirable, such as at least about 85%, or at least about 90%. Additionally or alternately, the conversion percentage can be about 95% or less, such as about 90% or less. These levels of conversion can also be useful, for example, for concentrating wax in the 650° F.+(343° C.+) or 700° F.+ (371° C.+) portion of a feedstock, or for forming a low sulfur fuel oil. Optionally, a feedstock with a sulfur content of about 3.0 wt % or less can be used when these higher levels of conversion are desired.

Solvent Assisted Hydroprocessing Hydroprocessed Product

Relative to the heavy oil feed component in the feedstream, the hydroprocessed product will be a material or crude product that exhibits reductions in such properties as average molecular weight, boiling point range, density and/or concentration of sulfur, nitrogen, oxygen, and metals.

In an embodiment of the invention, contacting the heavy oil feed component and recycle or other solvent component with the hydroprocessing catalyst in the presence of hydrogen to produce a hydroprocessed product is carried out in a single contacting zone. In another embodiment, contacting is carried out in two or more contacting zones. The total hydroprocessed product can be separated to form one or more particularly desired liquid products and one or more gas products.

In some embodiments of the invention, the liquid product is blended with a hydrocarbon feedstock that is the same as or different from the heavy oil feed component. For example, the liquid hydroprocessed product can be combined with a hydrocarbon oil having a different viscosity, resulting in a blended product having a viscosity that is between the viscosity of the liquid hydroprocessed product and the viscosity of the heavy oil feed component.

In some embodiments of the invention, the hydroprocessed product and/or the blended product are transported to a refinery and distilled to produce one or more distillate fractions. The distillate fractions can be catalytically processed to produce commercial products such as transportation fuel, lubricants, or chemicals. A bottoms fraction can also be produced, such as bottoms fraction with a 10% distillation point (such as measured by ASTM D2887) of at least about 600° F. (316° C.), or a 10% distillation point of at least about 650° F. (343° C.), or a bottoms fraction with a still higher 10% distillation point, such as at least about 750° F. (399° C.) or at least about 800° F. (427° C.).

In some embodiments of the invention, the hydroprocessed product has a total Ni/V/Fe content of at most 50%, or at most 10%, or at most 5%, or at most 3%, or at most 1% of the total Ni/V/Fe content (by wt %) of the heavy oil feed component. In certain embodiments, the fraction of the hydroprocessed product that has a 10% distillation point of at least about 650° F. (343° C.) and higher (i.e., 650° F.+ product fraction) has, per gram of 650° F.+ (343° C.+) product fraction, a total Ni/V/Fe content in a range of from $1\times10^{-7}$ grams to $2\times10^{-4}$ grams (0.1 to 200 ppm), or $3\times10^{-7}$ grams to $1\times10^{-4}$ grains (0.3 to 100 ppm), or $1\times10^{-6}$ grams to $1\times10^{-4}$ grams (1 to 100 ppm). In certain embodiments, the 650° F.+ (343° C.+) product fraction has not greater than $4\times10^{-5}$ grams of Ni/V/Fe (40 ppm).

In certain embodiments of the invention, the hydroprocessed product has an API gravity that is 100-160%, or 110-140% of that of the heavy oil feed component. In certain embodiments, API gravity of the hydroprocessed product is from 10°-40°, or 12°-35°, or 14°-30°.

In certain embodiments of the invention, the hydroprocessed product has a viscosity of at most 90%, or at most 80%, or at most 70% of that of the heavy oil feed component. In some embodiments, the viscosity of the hydroprocessed product is at most 90% of the viscosity of the heavy oil feed component, while the API gravity of the hydroprocessed product is 100-160%, or 105-155%, or 110-150% of that of the heavy oil feed component.

In an alternative embodiment, the 650° F.+(343° C.+) product fraction can have a viscosity at 100° C. of 10 to 150 cst, or 15 to 120 cst, or 20 to 100 zest. Most atmospheric resids of crude oils range from 40 to 200 cst. In certain embodiments, 650° F.+(343° C.±) product fraction has a viscosity of at most 90%, or at most 50%, or at most 5% of that of the heavy oil feed component.

In some embodiments of the invention, the hydroprocessed product has a total heteroatom S/N/O) content of at most 50%, or at most 10%, or at most 5% of the total heteroatom content of the heavy oil feed component.

In some embodiments of the invention, the sulfur content of the hydroprocessed product is at most 50%, or at most 10%, or at most 5% of the sulfur content (by wt %) of the heavy oil feed component. The total nitrogen content of the hydroprocessed product is at most 50%, or at most 10%, or at most 5% of the total nitrogen (by wt %) of the heavy oil feed component, and the hydroprocessed product has a total oxygen content that is at most 75%, or at most 50%, or at most 30%, or at most 10%, or at most 5% of the total oxygen content (by wt %) of the heavy oil feed component.

CONFIGURATION EXAMPLES

Figure 2:
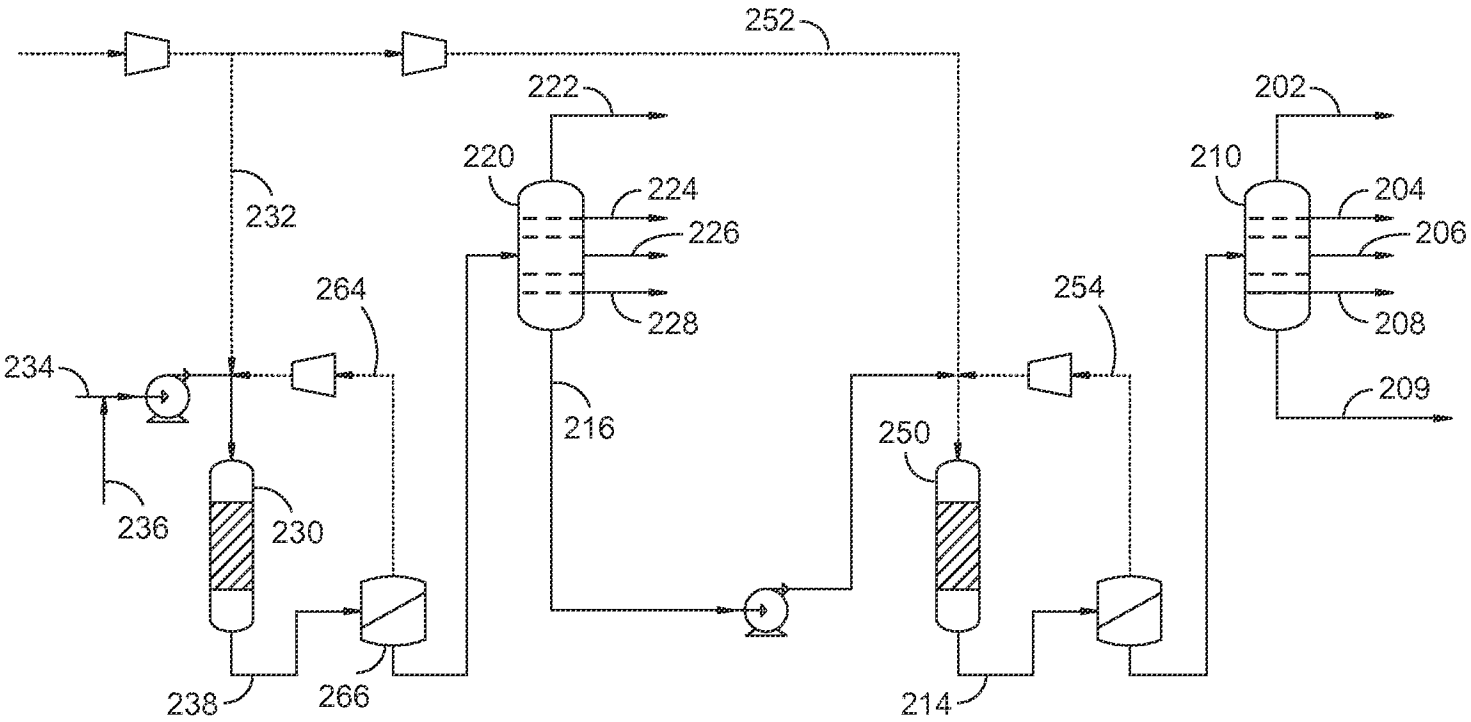
FIG. 2 shows an example of reaction system include a solvent assisted hydroprocessing stage and a slurry hydroconversion stage.

FIG. 2 shows an example of integration of solvent assisted hydroprocessing with slurry hydrocracking. In the example shown in FIG. 2, a solvent 236 as defined above is mixed with a resid or other heavy oil feed 234 for introduction into a hydroprocessing reactor 230. The effluent from the hydroprocessing reactor is separated 266 to remove gas phase products, such as hydrogen 264 that can be recycled after optional removal of contaminants. Recycled hydrogen 264 can be supplemented with make-up hydrogen 232. The liquid portion of the effluent is then fractionated 220 to form various products and a bottoms portion 216. The various products can include a light ends product 222, a naphtha product 224, a distillate fuel product 226, and a vacuum gas oil product 228. The bottoms portion 216 is then passed into a slurry hydroconversion reactor 250 for further conversion of the bottoms portion to lower boiling components. The hydrogen for the slurry hydroconversion can include a recycled hydrogen portion 254 and a make-up or fresh hydrogen portion 252. The effluent 214 from the slurry hydroconversion reactor can optionally be initially separated to remove gas phase compounds, and then can be fractionated 210 to recover products such as light ends 202, naphtha 204, distillate fuel 206, vacuum gas oil 208, and bottoms 209.

Figure 3:
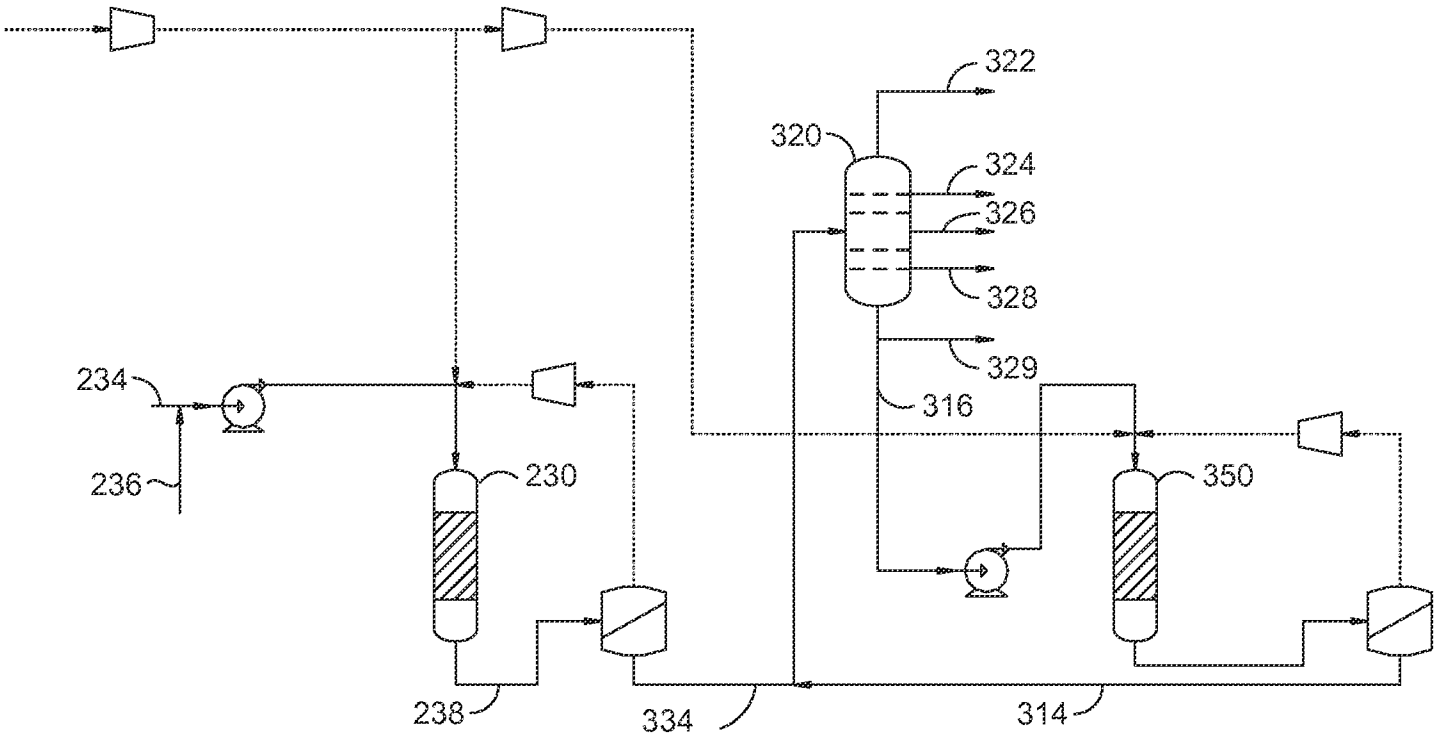
FIG. 3 shows an example of reaction system include a solvent assisted hydroprocessing stage and a slurry hydroconversion stage.

FIG. 3 shows another example of integration of solvent assisted hydroprocessing with slurry hydroconversion. In FIG. 3, a configuration similar to FIG. 2 is shown, but only one fractionator 320 is used. Thus, the products from both hydroprocessing 334 and slurry hydroconversion 314 are fractionated 320 together to form common outputs, such as light ends 322, naphtha product 324, distillate fuel (diesel) product 326, vacuum gas oil 328, and a bottoms or resid product 329. In the configuration shown in FIG. 3, a portion of the bottoms product 329 is used as a feed 316 for the slurry hydroprocessing reactor 350.

Figure 4:
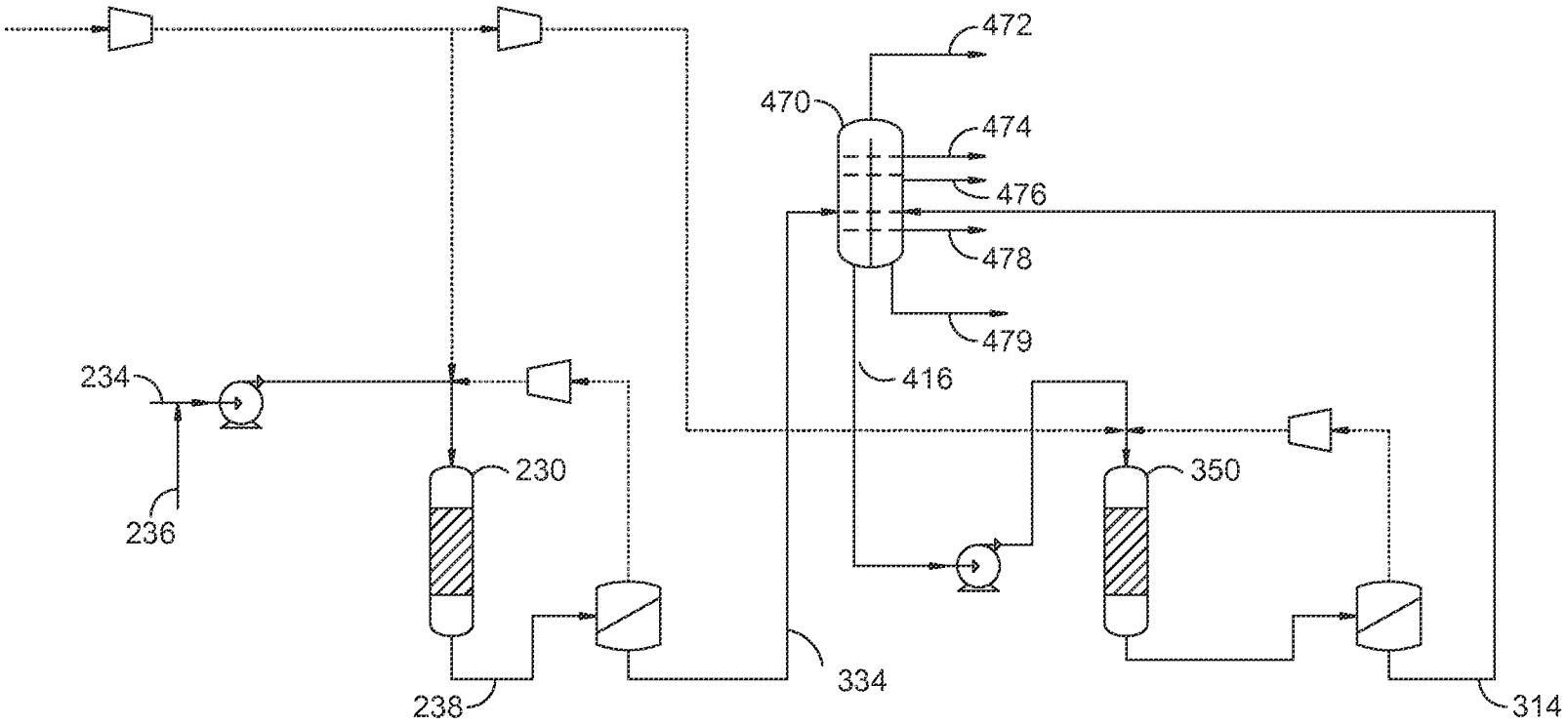
FIG. 4 shows an example of reaction system include a solvent assisted hydroprocessing stage and a slurry hydroconversion stage.

FIG. 4 shows a further variation of the configuration in FIG. 3, where the common fractionator corresponds to a divided wall column fractionator 470. The divided wall column fractionator 470 in FIG. 4 allows a single fractionators to be used, but with lower boiling portions of the products, such as the naphtha 474 or light ends portions 472, being fractionated in a common volume. The higher boiling portions, such as distillate fuel products 474 and vacuum gas oil 476, remain separated. This means that separate distillate fuel and vacuum gas oil products can be recovered from the solvent assisted hydroprocessing unit 230 and the slurry hydroprocessing unit 350. The bottoms fraction 478 and feed to slurry hydroprocessing 416 can be separate or in common, depending on the desired configuration. This can allow for use of a single fractionator while maintaining separate control over the output properties of the fractions from hydroprocessing and slurry hydroconversion.

Integration of Slurry Hydroconversion in a Refinery Setting

Figure 5:
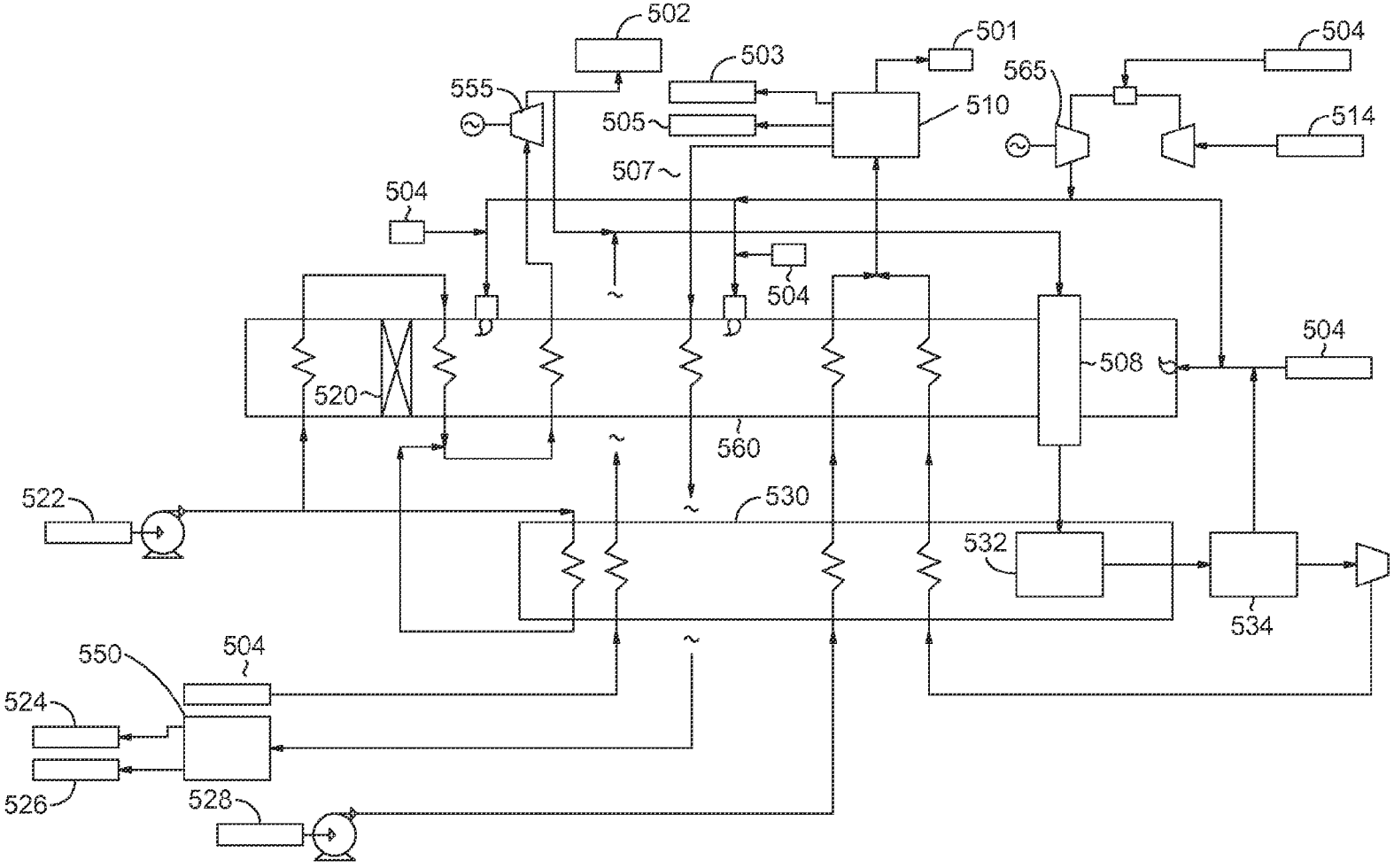
FIG. 5 shows an example of integrating a slurry hydroconversion reactor into a refinery network.

In various aspects, an integrated system is provided for incorporating slurry hydroconversion into a refinery setting. FIG. 5 shows an example of an integrated scheme. In FIG. 5, a slurry hydroconversion reactor is included in a refinery that also has a gas turbine for electric power generation.

Hydrogen can be generated from natural gas 504 or another reformable fuel using steam methane reforming 508 and shift conversion 532. Heat for the steam methane reforming section 508 can be provided via a fired heater 560. Hydrogen can be purified using pressure swing adsorption 534. The high purity hydrogen is compressed and then heated via the heat recovery network 530 and then through the fired heater 560. Vacuum resid and/or heavy hydrocarbon streams 528 are heated in the heat recovery network 530 and then through the fired heater. This stream is combined with the heated hydrogen from the fired heater 560 and catalyst and sent to the slurry hydroconversion reactor 510. The reaction products are separated via a series of flash drums and an atmospheric fractionator into products such as light ends 501, naphtha 503, diesel or distillate fuel 505, atmospheric tower bottoms 507, and internal recycle streams. The atmospheric tower bottoms can be further heated in the fired heater 560 and sent to a vacuum tower 550 where it is separated into products, such as a light vacuum gas oil 524, a heavy vacuum gas oil 526, and a slurry hydroconversion pitch (not shown).

Boiler feed water 533 is converted into very high pressure steam via heat recovery network 530 and the fired heater 560. Steam is fed to a turbine 555 where power is generated. A portion of the steam from the turbine 555, at a lower pressure, is used for the steam methane reforming reaction 532 and the remaining is sent to other steam users for the integrated process e.g. velocity steam, stripping steam and vacuum jet ejectors.

Natural gas 504 or any other hydrocarbon stream can be used as a fuel for a gas turbine 565. The gas turbine exhaust is used as hot air and is used with additional natural gas and pressure swing adsorption offgas that provides the heat in the fired heater 560. All of the gas turbine exhaust can be sent to the main burners of the fired heater 560 or a portion can be sent to duct burners to increase the temperature in other parts of the fired heater 560.

This integrated scheme can reduce energy consumption, as a single large fired heater and convection section can be used to provide all the high level heat required by the process. Conventional practice will require at least four fired heaters. Furthermore, this scheme can increase the size of the gas turbine and thus the capital will be lower due to economy of scale. Use of combined heat and power for the integrated process will be energy efficient.

Various other embodiments of the same concept can be possible. For example, simultaneously use the gas turbine exhaust as combustion air to the hydrogen reformer, hydrogen furnace, feed furnace and slurry hydrocracker vacuum furnace. Alternatively, the hydrogen feed to the slurry hydrocracker can be compressed to high pressure and heated up in the steam methane reforming furnace to the reaction temperature before sending it to the slurry hydrocracker reactor. This eliminates the need for a separate hydrogen furnace, decreases the steam generation in the hydrogen plant, and will improve the energy efficiency.

Quenching of Slurry Hydroconversion Effluent

Figure 6:
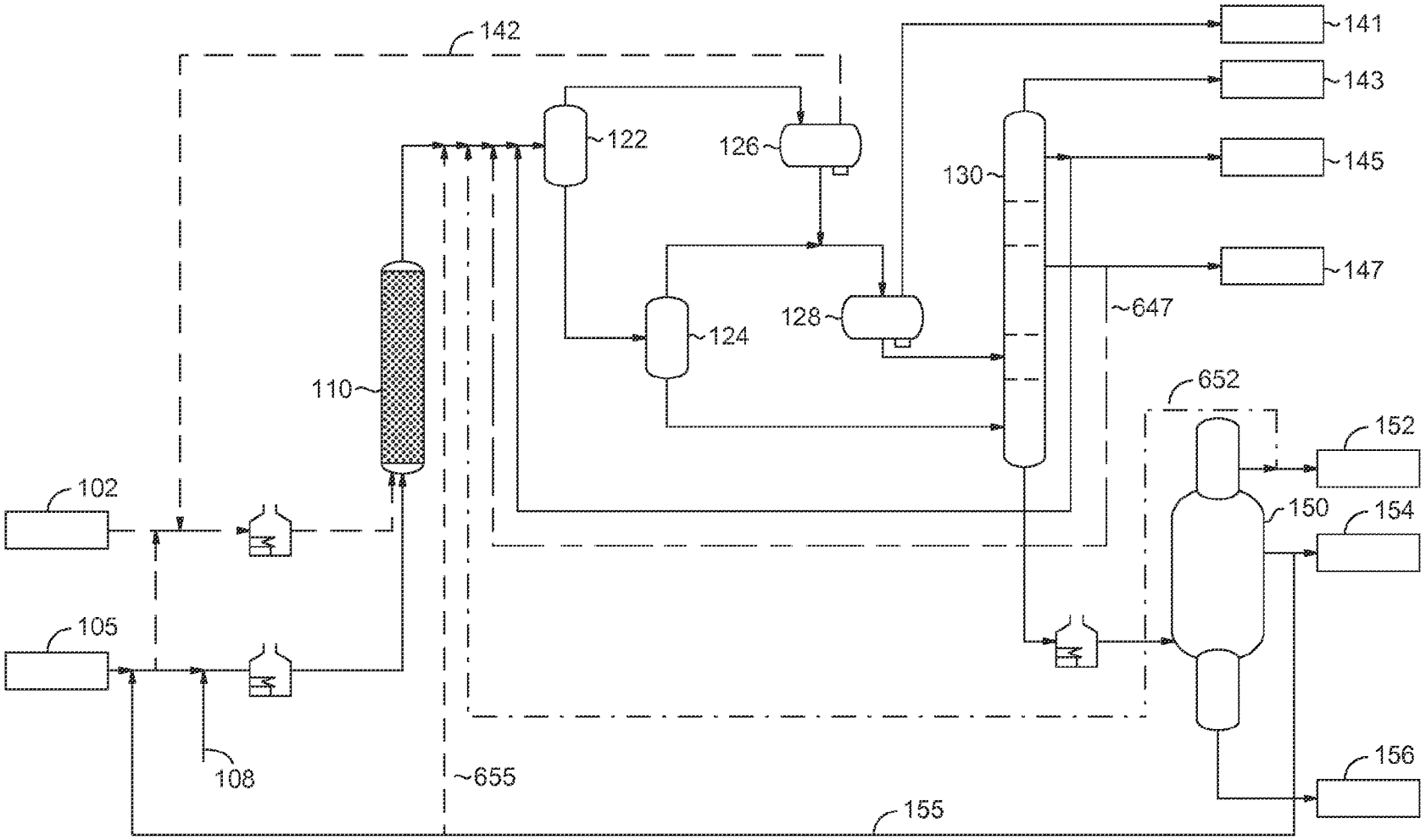
FIG. 6 shows an example of an alternative configuration for a slurry hydroconversion reaction system.

FIG. 6 shows a variation on the configuration in FIG. 1 that includes quenching of the slurry hydroconversion effluent. In FIG. 6, a portion of the vacuum gas oil output generated as a product can optionally be used as a recycled feed stream for a slurry hydroconversion reactor. To the degree that temperature control is desired for the effluent from the slurry hydroconversion reactor, a hydrogen stream can be used, such as hydrogen 652 recycled from light ends 152. Alternatively, one or more product streams can be used to quench the effluent from slurry hydroconversion, such as a recycled portion 647 of vacuum gas oil product 147 or a portion 655 of vacuum gas oil recycle 155.

As shown in FIG. 1 or 6, fractionators(s) can be used to separate a plurality of product streams from a slurry hydroconversion effluent. Optionally but preferably, the product streams can be separated out after hydrotreatment of the effluent to reduce the sulfur and nitrogen levels. This type of recycle can reduce or eliminate the need for a hydrogen quench of the slurry hydroconversion effluent.

ADDITIONAL EMBODIMENTS

Embodiment 1

A method for processing a heavy oil feedstock, comprising: providing a heavy oil feedstock having a 10% distillation point of at least about 650° F. (343° C.); exposing the heavy oil feedstock to a catalyst in the presence of hydrogen and a solvent under first effective hydroprocessing conditions to form an effluent comprising at least a plurality of liquid products and a hydroprocessing bottoms product, the effective hydroprocessing conditions including a temperature of at least about 360° C. and a liquid hourly space velocity of the fraction of the combined feedstock boiling above 1050° F.). (566°) of at least about 0.10 $hr^{-1}$; exposing the hydroprocessing bottoms product to a catalyst in the presence of hydrogen under second effective slurry hydroconversion conditions to form a slurry hydroconversion effluent comprising at least a second plurality of liquid products and a bottoms product; and fractionating the first plurality of liquid products and the second plurality of liquid products.

Embodiment 2

The method of Embodiment 1, wherein the solvent component comprises a recycle component, the process further comprising recycling a second portion of the liquid effluent to form the recycle component.

Embodiment 3

The method of Embodiment 2, wherein the ratio of the recycle component to the heavy oil feed component on a weight basis is from about 0.3 to about 6.0.

Embodiment 4

The method of any of the above embodiments, wherein the effective hydroprocessing conditions are effective for conversion of from about 50 to about 70% of the 1050° F.+ (566° C.+) portion of the heavy oil feed feedstock.

Embodiment 5

The method of any of the above embodiments, wherein the solvent comprises at least a portion of the distillate product, at least 90 wt % of the at least a portion of the distillate product having a boiling point in a boiling range of 300° F. (149° C.) to 750° F. (399° C.).

Embodiment 6

The method of any of the above embodiments, further comprising fractionating at least a portion of the first liquid products, the second liquid products, or a combination thereof.

Embodiment 7

The method of Embodiment 6, wherein the first liquid products and the second liquid products are fractionated in a common fractionator.

Embodiment 8

The method of Embodiment 6 or 7, wherein the common fractionator comprises a divided wall fractionator.

Embodiment 9

The method of any of the above embodiments, further comprising hydrotreating at least a portion of the second plurality of liquid products.

Embodiment 10

The method of any of the above embodiments, further comprising: combining at least a portion of one or more of the first plurality of liquid products with at least a portion of one or more of the second liquid product; hydroprocessing the combined liquid products; and fractionating the hydroprocessed combined liquid products.

Embodiment 11

The method of Embodiment 10, wherein hydroprocessing the combined liquid products comprises hydrotreating the combined liquid products.

Embodiment 12

A method for processing a heavy oil feedstock, comprising: providing a heavy oil feedstock having a 10% distillation point of at least about 650° F. (343° C.); exposing the heavy oil feedstock to a catalyst in the presence of hydrogen under first effective slurry hydroconversion conditions to form a slurry hydroconversion effluent comprising at least a plurality of liquid products and a bottoms product, wherein the hydrogen is provided by reforming of a reformable fuel, and wherein the hydrogen and the heavy oil feedstock are heated in a common heating zone.

Embodiment 13

The method of any of the above embodiments, further comprising coking a second feedstock under effective coking conditions, wherein the second feedstock is heated in the common heating zone.

Embodiment 14

The method of any of the above embodiments, wherein a 10% distillation point of the heavy oil feedstock is at least about 900° F. (482° C.).

Embodiment 15

The method of any of the above embodiments, wherein the heavy oil feedstock has a Conradson carbon residue of about 27.5 wt % or less, such as about 25 wt % or less.

Embodiment 16

The method of any of the above embodiments, wherein the heavy oil feedstock has a Conradson carbon residue of at least about 30 wt %.

Embodiment 17

The method of any of the above embodiments, wherein a portion of at least one of the plurality of liquid products is added to the slurry hydroconversion effluent as a quench stream.

What is claimed is:

1. A method for processing a heavy oil feedstock, comprising:

providing a combined feedstock comprising a heavy oil feedstock having a 10% distillation point of at least about 650° F. (343° C.) and a solvent component, wherein the solvent component has an ASTM D86 90% distillation point of less than 300° C.;

exposing the combined feedstock to a catalyst in the presence of hydrogen under first effective hydroprocessing conditions to form a first slurry hydroconversion effluent comprising at least a first plurality of liquid products and a first hydroprocessing bottoms product, the first effective hydroprocessing conditions including a temperature of at least about 680° F. (360° C.) and a liquid hourly space velocity of the fraction of the combined feedstock boiling above 1050° F. (566° C.) of at least about 0.10 $hr^{-1}$;

exposing the first hydroprocessing bottoms product to a catalyst in the presence of hydrogen under second effective slurry hydroconversion conditions to form a second slurry hydroconversion effluent comprising at least a second plurality of liquid products and a second hydroprocessing bottoms product; and fractionating the first plurality of liquid products and the second plurality of liquid products.

2. The method of claim 1, wherein the solvent component comprises a recycle component containing at least a portion of the second slurry hydroconversion effluent.

3. The method of claim 2, wherein the ratio of the recycle component to the heavy oil feed component on a weight basis is from about 0.3 to about 6.0.

4. The method of claim 1, wherein the first effective hydroprocessing conditions are effective for conversion of from about 50 to about 70% of the 1050° F.+(566° C.+) portion of the heavy oil feed feedstock.

5. The method of claim 1, wherein the solvent component comprises at least a portion of the first slurry hydroconversion effluent.

6. The method of claim 1, further comprising fractionating at least a portion of the first plurality of liquid products, the second plurality of liquid products, or a combination thereof, the first plurality of liquid products and the second plurality of liquid products optionally being fractionated in a common fractionator.

7. The method of claim 6, wherein the common fractionator comprises a divided wall fractionator.

8. The method of claim 1, further comprising hydrotreating at least a portion of the second plurality of liquid products.

9. The method of claim 1, further comprising:

combining at least a portion of one or more of the first plurality of liquid products with at least a portion of one or more of the second plurality of liquid products;

hydroprocessing the combined liquid products; and fractionating the hydroprocessed combined liquid products, optionally wherein hydroprocessing the combined liquid products comprises hydrotreating the combined liquid products.

10. The method of claim 1, further comprising coking a second feedstock under effective coking conditions, wherein the second feedstock is heated in a common heating zone.

11. The method of claim 1, wherein a 10% distillation point of the heavy oil feedstock is at least about 900° F. (482° C.).

12. The method of claim 1, wherein the heavy oil feedstock has a Conradson carbon residue of about 27.5 wt % or less.

13. The method of claim 1, wherein the heavy oil feedstock has a Conradson carbon residue of at least about 30 wt %.

14. The method of claim 1, wherein a portion of at least one of the first plurality of liquid products is added to the first slurry hydroconversion effluent as a quench stream.

15. The method of claim 1, wherein the first effective hydroprocessing conditions further include a hydrogen partial pressure of about 1000 psig (6895 kPa-g) or less.

* * * * *